United States Patent [19]

Naumann

[11] Patent Number: 5,074,538

[45] Date of Patent: Dec. 24, 1991

[54] APPARATUS FOR SEPARATING AND CONVEYING STACKED SHEETS

[75] Inventor: Reinhard Naumann, Delitzsch, German Democratic Rep.

[73] Assignee: Veb Kombinat Polygraph "Werner Lamberz" Leipzig, Leipzig, Fed. Rep. of Germany

[21] Appl. No.: 457,328

[22] Filed: Dec. 27, 1989

[30] Foreign Application Priority Data

Dec. 27, 1988 [DD] German Democratic Rep. ..... 3239947

[51] Int. Cl.[5] ..... B65H 5/08

[52] U.S. Cl. ..... 271/11; 271/98; 271/108

[58] Field of Search ..... 271/97, 98, 104, 11, 271/264, 194, 196, 108, 90

[56] References Cited

U.S. PATENT DOCUMENTS

| | | | |
|---|---|---|---|
| 4,200,277 | 4/1980 | Klenk et al. | 271/90 |
| 4,640,503 | 2/1987 | Naumann | 271/90 X |
| 4,759,537 | 7/1988 | Illig et al. | 271/11 |
| 4,822,022 | 4/1989 | Attenasio | 271/97 |

FOREIGN PATENT DOCUMENTS

| | | | |
|---|---|---|---|
| 1803017 | 6/1969 | Fed. Rep. of Germany | 271/90 |
| 2220353 | 6/1981 | Fed. Rep. of Germany . | |
| 1143018 | 4/1957 | France | 271/11 |
| 143754 | 9/1980 | German Democratic Rep. | 271/90 |
| 58-63634 | 4/1983 | Japan | 271/98 |
| 726802 | 8/1981 | U.S.S.R. | 271/11 |
| 2161144 | 1/1966 | United Kingdom | 271/90 |

*Primary Examiner*—Robert P. Olszewski
*Assistant Examiner*—Cheryl L. Gastineau
*Attorney, Agent, or Firm*—Michael J. Striker

[57] ABSTRACT

The apparatus for separating and stacking stacked sheets is used for a pneumatic sheet separation and conveying mechanism in a sheet feeder of sheet processing machines. In the apparatus of the invention the blowing under of a sheet separated from the stack in the first motion stage of the conveying suction mechanism is maintained and a reliable separation of the sheets is guaranteed by an operational separation of a second type of conveying suction device located between the separating suction devices at the sheet edge remote from the first conveying suction devices. The second conveying suction device separate from the first conveying suction devices is associated with a second separating suction device operating according to the pressure difference principle. The second conveying suction device comprises a housing including a cylinder connected to the suction air, in which a piston is slidably mounted, which has a suction head located on its end opposite a piston outside the housing, which receives the separated sheet when acted on with suction air and reliably keeps the sheet on a first portion of a feed path until the piston is in its automatic air feed position, in which air flows in through an air opening located in the piston rod, the piston then returns to its normal position after automatically delivering the sheet.

5 Claims, 7 Drawing Sheets

1
2
3
4
5
6
7
8
9
10
11
12
13
14
15
16
17
18
19

APPARATUS FOR SEPARATING AND CONVEYING STACKED SHEETS

BACKGROUND OF THE INVENTION

My invention relates to an apparatus for separating and feeding stacked sheets for a pneumatic sheet separating and conveying mechanism in a sheet feeder of a sheet processing machine.

A suction head in a sheet feeder for a sheet processing machine is described in German Patent 22 20 353, which is provided with separating suction for lifting a sheet from a stack and with conveying suction, which is needed to feed the sheets in the direction of other sheet conveying means. These devices, and other devices having the same basic principle, separate and feed the sheets according to a rear edge principle in such a way that the upper sheet of the stack is preloosened at its rear edge by one or more blower nozzles and the uppermost sheet of the stack is gripped at its rear edge by a mechanical spring-operated separating suction device and/or by a separating suction device operating according to the pressure difference principle. The sheets are thereby moved forward with their rear edges for the purpose of a reliable separation by a skimmer element. After that, a separating member swings into the gap formed between the lifted sheet and the remaining stack and presses on the sheet lying under it, so that, as a result of the applied force, the sheets remaining in the stack are fixed in their position. Simultaneously compressed air is blown under one end of the lifted sheet, since as large as possible a loosening of the sheet should be attained. During the blowing-under stage, the sheet is gripped by conveying suction located downstream of the separating suction and simultaneously released by blowing air from the separating suction devices and is conveyed by the suction conveyer system with the conveying suction to the belt transport system and transferred to it.

In this process there is a series of connections which determine the individual process stages of the described mechanism and the time interval and arrangement for return to their starting configuration. Thus, the separating suction and also the conveying suction only grasp the new following sheet, when the preceding sheet has passed into the working range of some suction device. The under blowing of the sheet can occur only in the time interval between activation of the separating member and the time at which air is blown from the separating suction devices. No reliable separation of large sheets of the stack can be attained in the processing of large sheets and/or of sheets with a length which is large in the feed direction in this short time interval, so that the output of the known apparatus is limited and the structure of the sheet feeder machines no longer attains the high output parameters.

To avoid this difficulty the time of blowing under the sheets was indeed extended by the additional arrangement of suction units connected operationally with the conveying suction mechanisms at the level of the sheet rear edges, so that the sheet separation is somewhat improved and the sheet feed is supported by the air stream acting in the feed direction, however the output increase of such an apparatus made possible by increasing the blowing-under time is not sufficient, since, because of the arrangement additional suction devices in the already highly loaded conveying system, its performance limit regarding the allowed following cycles is limited. Moreover the reliability of operation is reduced during processing stacks of sheets with undulating surfaces by suction devices distributed over the larger surface areas.

SUMMARY OF THE INVENTION

Accordingly, it is an object of my invention to provide a separating and conveying apparatus for stacked sheets whose output is greater than that of the prior art.

It is another object of my invention to provide a separating and conveying apparatus for stacked sheets which can be part of a high performance aggregate of processing machines, whose operating parameters can be optimized and which can perform reliably.

In keeping with these objects and with others which will become apparent hereinafter, a number of second conveying suction devices are located between the separating suction devices at the sheet rear edges and are operationally separate from the first conveying suction devices, but at the same time the under blowing of the individual separated sheet is still guaranteed in the first motion stage of the conveying suction devices. Also the reliable separation of the sheets from the stack is also possible with undulating surfaces.

The apparatus for separating and conveying a plurality of stacked sheets, comprises a plurality of preloosening blower nozzles, skimmer elements, blower nozzles for blowing under a separated sheet from the stack and also comprising first conveying suction devices and first separating suction devices, in which second separating suction devices operating according to the pressure difference principle are associated with the first separating suction devices, which form a functional unit with one of the preloosening blower nozzles, one of said skimmer elements and one of said blower nozzles to blow under said separated sheet. The second conveying suction device is operationally associated with the separating suction devices. This additional conveying suction device comprises a housing including a cylinder having a suction air connector, a guide sleeve mounted in the cylinder, a piston having a piston rod axially slidably mounted in the guide sleeve in the cylinder, a spring, and a suction head mounted on a guide element. The piston is urged into a normal position in the cylinder by the spring. The piston rod has an axially through-going suction duct and a wall formed by the suction duct provided with a through-going passage located between the piston and the guide sleeve for operational connection of the suction head and also with an air feed opening positioned in the feed direction of the sheets between the passage and the suction head, so that the distance between the outer edges of the air feed opening and the passage corresponds to a distance equal to or less than the length of the guide sleeve and the distance of the passage from the piston corresponds at least to the axial width of the air feed opening.

Several embodiments of our invention are possible. At least one of the second separating suction devices operating according to the pressure difference principle, at least one of the preloosening nozzles, a skimmer element, and one of the blower nozzles for blowing under the separated sheet form a structural unit with the second conveying suction device. For definite determination of a force acting no the piston opposite to the feed direction of the sheets the piston rod on an end opposite the suction head projects through the front wall of the housing, is slidably mounted axially in a second guide sleeve and optimized in diameter and a cylindrical space formed by the housing, the piston, the guide sleeve and the portion of the piston rod projecting through the housing wall is connected operationally by a connecting opening with the suction duct.

Advantageously the guide element can be a guide bolt projecting from the piston rod opposite the piston. The suction head can be mounted on the guide bolt adjacent an end of the piston rod opposite from the piston.

By the omission of the feed suction between the separating suction at the stack rear edge the feed suction mechanism is substantially unloaded, since the attachment rods for these suction devices can be eliminated whereby they can be operated with a substantially higher operating power. The loading of the conveying suction mechanism, which arises by the moving parts of the conveying suction device according to our invention, is very minimal, since they are operable only in a first stage of operation, in which the motion speed is relatively slow. Hence on coupling of the apparatus according to our invention to a high performance unit for sheet processing the operating parameters can be optimized with a higher reliability. Moreover the separating suction devices movable mechanically and attached to the suction rod can be reduced to a minimum in the region of the separating member, since there is an absolute requirement to avoid feeding of doubled-up sheets, which is only provided by separating devices moving with the predetermined displacement speed. Also with undulating stack surfaces the separating suction devices which are the subject of the invention are only adjusted in a reduced sheet width. The separating and conveying suction devices provided in a structural unit with the associated functioning elements are adjusted in height and laterally at each arbitrary location in the vicinity of the stack rear edge with only minimal operator effort. These structural units are easily varied in number and arrangement depending on the sheet width. Especially by the different height adjustment and variable arrangement the processing of the stacks of greater size and stacks with undulating stack surfaces occur with higher output and reliability. As required the conveying suction devices according to our invention can be associated with the mechanically moving separating suction devices.

BRIEF DESCRIPTION OF THE DRAWING

The objects, features and advantages of my invention will be made more apparent from the following detailed description, reference being made to the accompanying drawing in which.

DETAILED DESCRIPTION OF THE INVENTION

Figure 1:
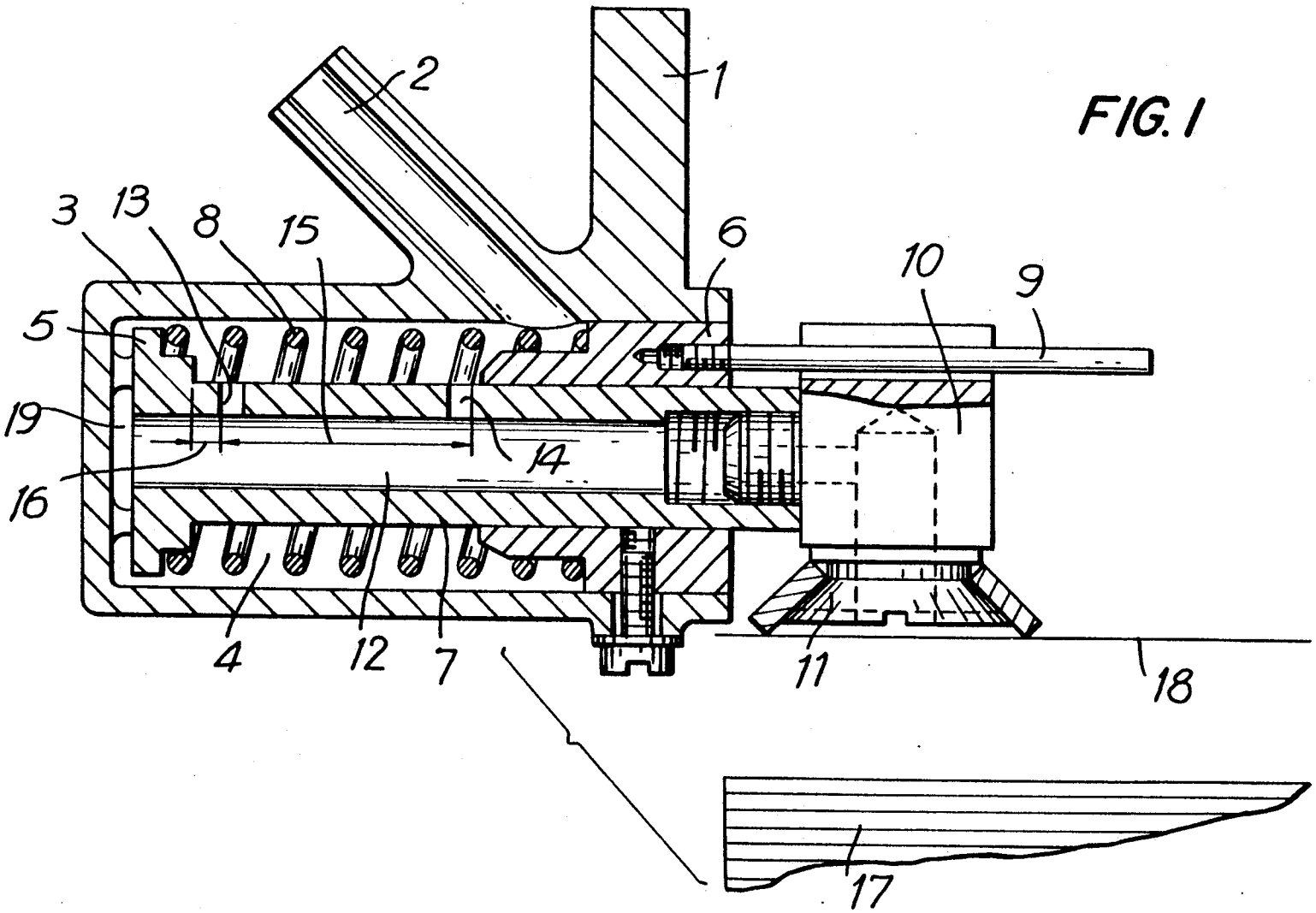
FIG. 1 is a cross sectional view of one embodiment of a second conveying suction device 1 according to my invention in its normal or starting position.

In FIG. 1 a second conveying suction device 1 according to the invention combined in its operation and structure with a second separating suction device operating according to the pressure difference principle is shown in its normal position. It comprises a housing 3 provided with the suction air connector 2, in whose cylinder 4 the piston 5 and in whose guide sleeve 6 the associated piston rod 7 are mounted axially slidable. The piston 5 is held in its normal position by the spring 8. On the end of the piston rod 7 opposite from the piston 5, the suction head 10 is attached nonrotatably and guided on a guide bolt 9 attached to the guide sleeve 6. The suction head 10 has a truncated cone shaped suction mouth 11. The passage 13 between the piston 5 and the guide sleeve 6 located in the wall 7' of the piston rod 7 acts to connect the suction head 10, the suction duct 12 extending through the piston rod 7, the cylinder 4 and the suction air connector 2. The air feed openings 14 are located in the sheet feed direction between the passage 13 and the suction head 10. The axial distance between the outer edges of both the passage 13 and the opening 14 is the distance 15 which is equal to or less than the length of the guide sleeve 6. The distance 16 of the passage 13 from the piston corresponds to the axial dimension of the air feed opening 14.

In operation of the apparatus according to our invention, the uppermost sheet 18 is gripped by the second separating suction device on directing suction to the moving suction device lowered mechanically after loosening of the upper sheet from the sheet stack 17 by the pressurized air issuing from the loosening blower nozzles (26.1 to 26.6). After that the sheet is lifted separately by raising the second separating suction device from the sheet stack 17. Simultaneously the second separating suction devices operating according to the pressure difference principle are acted on with suction or vacuum intake air on admission of suction air to the first mechanically moving separating suction device (27.1 to 27.4). Because of that the piston provided with the suction head extends, grips the sheet 18 and moves with it back into its normal position. During the lifting of the sheet 18 the skimmer element secures its reliable separation. Subsequently the blowing under of the separated sheet occurs by blowing air through the corresponding nozzles. After the predetermined operating cycle of the separating and conveying apparatus during the under blowing stage the connection of the second conveying suction devices 1 according to our invention occurs simultaneously with the connection of the suction air to the mechanically moving conveying suction. Because of that the sheet 18 is gripped at its rear edge by the suction mouth 11 of the suction head 10 and also the blowing under of the sheet 18 can occur further after the feed of the separating air. Since the blowing under of the sheet 18 required by the working cycle of the apparatus according to our invention occurs only in the first portion of its conveying path determined by the conveyor suction mechanism, the sheet 18 is held by the conveying suction device 1 only in this region. The special operation of the second conveying suction device 1 described subsequently.

Figure 2:
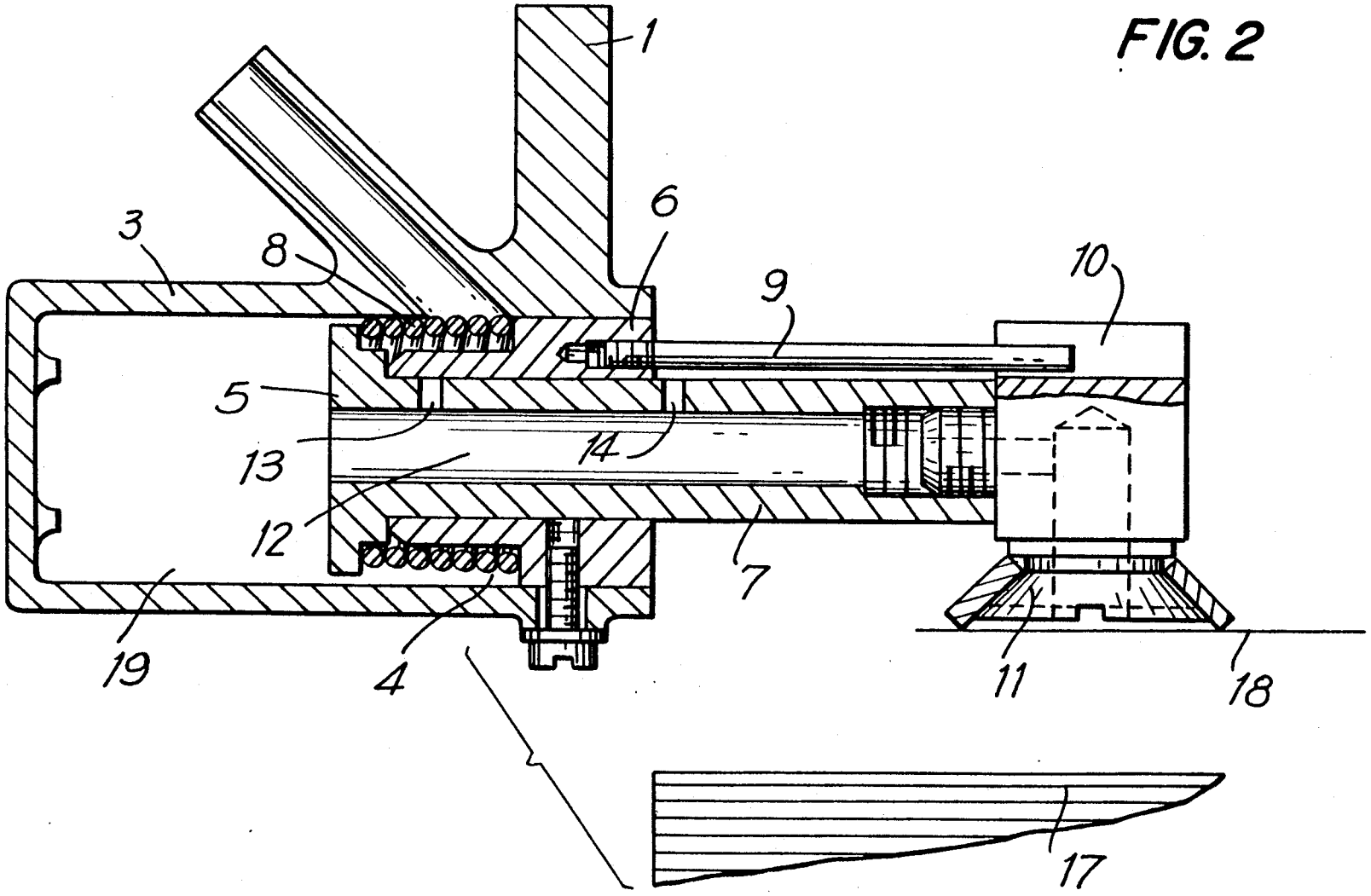
FIG. 2 is a cross sectional view of the second conveying suction device of FIG. 1 in its operating position.

The rear edge of the sheet 18 is fed before the suction mouth 11 of the suction head 10 by the separating suction. The piston 5 is held in its normal position during this time by the spring 8. The sheet 18 is pulled or drawn in the appropriate direction by a partial vacuum produced in the cylinder 4, in the cylindrical space 19 formed by the piston 5 and the front wall of the housing 3, in the passage 13, in the air feed opening 14, in the suction duct 12 and in the suction mouth 11 of the suction head 10 by connection of the suction air connector 2. The piston 5 is acted on additionally by a force which is proportional to the partial vacuum acting on the piston rod cross section and acts in the direction of the compression force, also opposite to the feed direction. That has the consequence that the sheet is stretched by the feed motion between the separating suction device moved by the conveying suction mechanism and the second conveying suction device 1 according to the invention located at the rear sheet edge. With the feed motion of the sheet 18 the suction head 10 and thus the piston rod 7 is moved with the piston 5 from its normal position in the sheet feed direction. During this stroke first the air feed opening 14 is covered and then shortly before reaching the end of the stroke the passage 13 is covered by the guide sleeve 6. Because of that the suction air feed from the cylinder 4 to the suction duct 12 and thus to the cylindrical space 19 and to the suction head 10 is interrupted. The partial vacuum still existing in the cylinder 4 and the residual vacuum acting on the suction mouth 11 cause the air feed openings 14, as shown in FIG. 2, to be opened by motion of the piston rod 7 outside of the guide sleeve 6 of the housing 3 so that the vacuum duct 12, the cylindrical space 19 and the suction head 10 are fed air and sheet 18 is released from the suction mouth 11. Until feeding air the piston 5 is held in its end position (opposite the normal position) by the vacuum in the cylinder 4 against the force of the spring 8. After taking the sheet 18 on the conveyor belt system the conveying suction device moves by the conveying suction mechanism and simultaneously also the cylinder 4 in the conveying suction device 1 according to our invention are fed air through the suction air intake connector 2 so that the spring 8 moves the piston 5 back into its normal position, where it is prepared for a new operating displacement.

Figure 3:
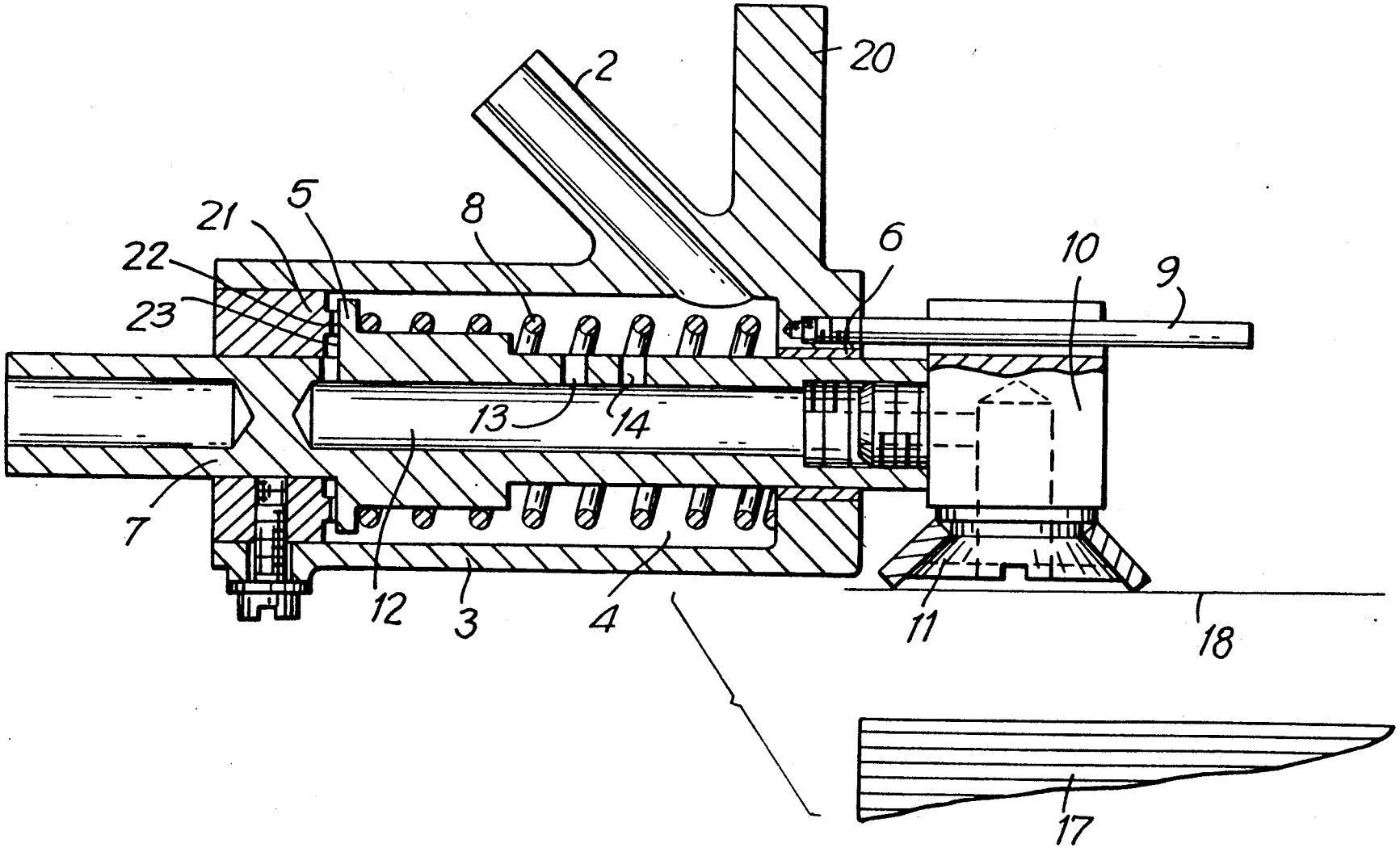
FIG. 3 is a cross sectional view of another embodiment of a second conveying suction device 20.

The second conveying suction device 20 shown in FIG. 3 differs from the first embodiment because of definite choice or determination of the force acting on the piston 5 opposite the forward motion direction of the sheets. The piston rod 7 projects through the front wall 25 of the housing 3 on its end opposite from the suction head 10 and is mounted axially slidable in a second guide sleeve 21 and is optimized in its diameter. The cylindrical space 22 formed by the housing 3, the piston 5, the guide sleeve 21 and the portion of the piston rod 7 projecting through the housing wall 25 is operationally connected with the suction duct 12 by the connecting opening 23. In the conveying suction device 20 it is possible to influence the size and action of the force acting on the piston rod by dimensional differences in the piston rod diameter and thus in its cross section. In this embodiment it is possible to design the conveying suction device so that after it is acted on with suction intake air and after drawing the sheet to it a conveying motion occurs.

Figure 4:
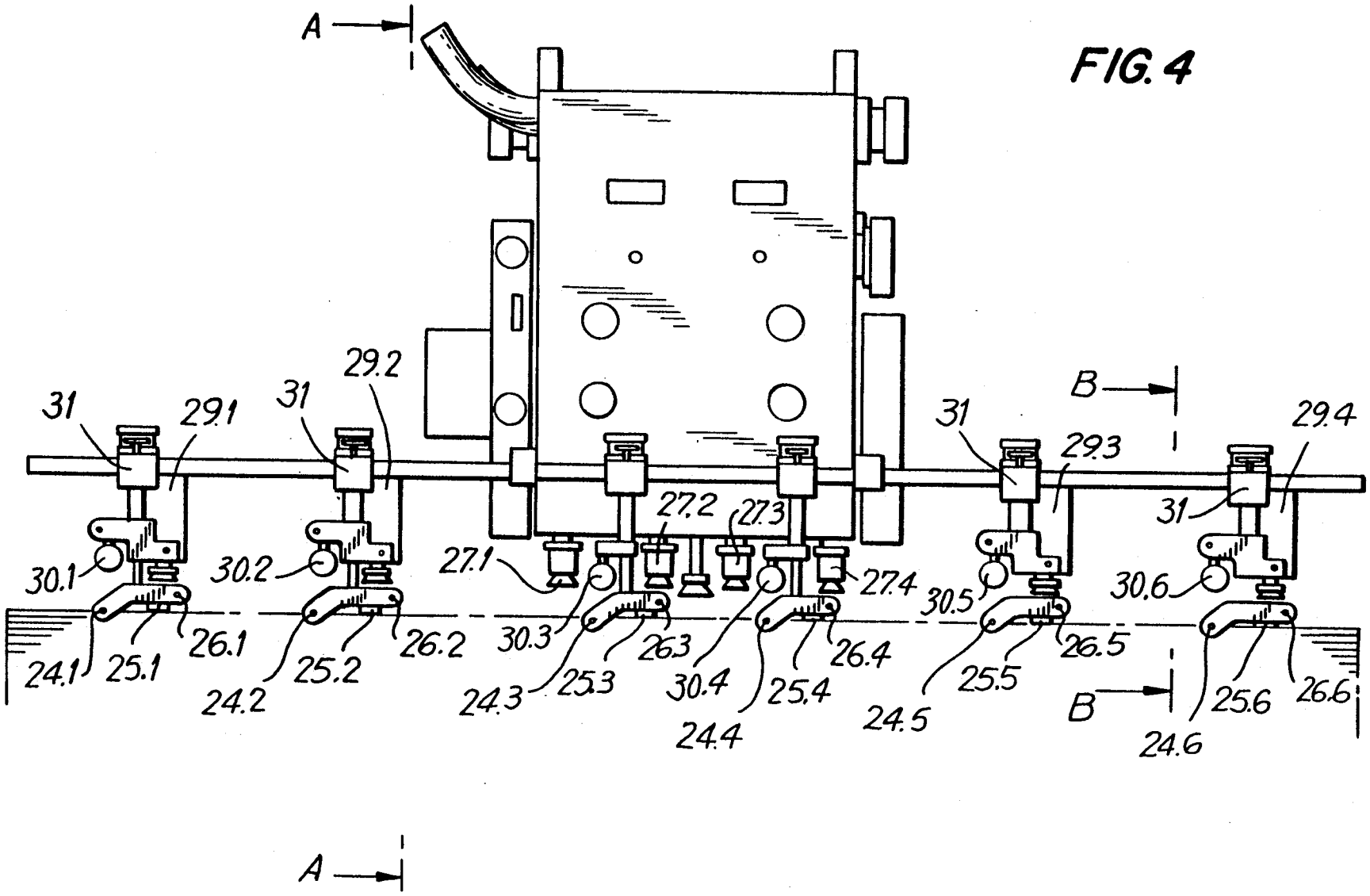
FIG. 4 is a schematic side elevational view of an entire apparatus for separating and conveying stacked sheets.
Figure 5:
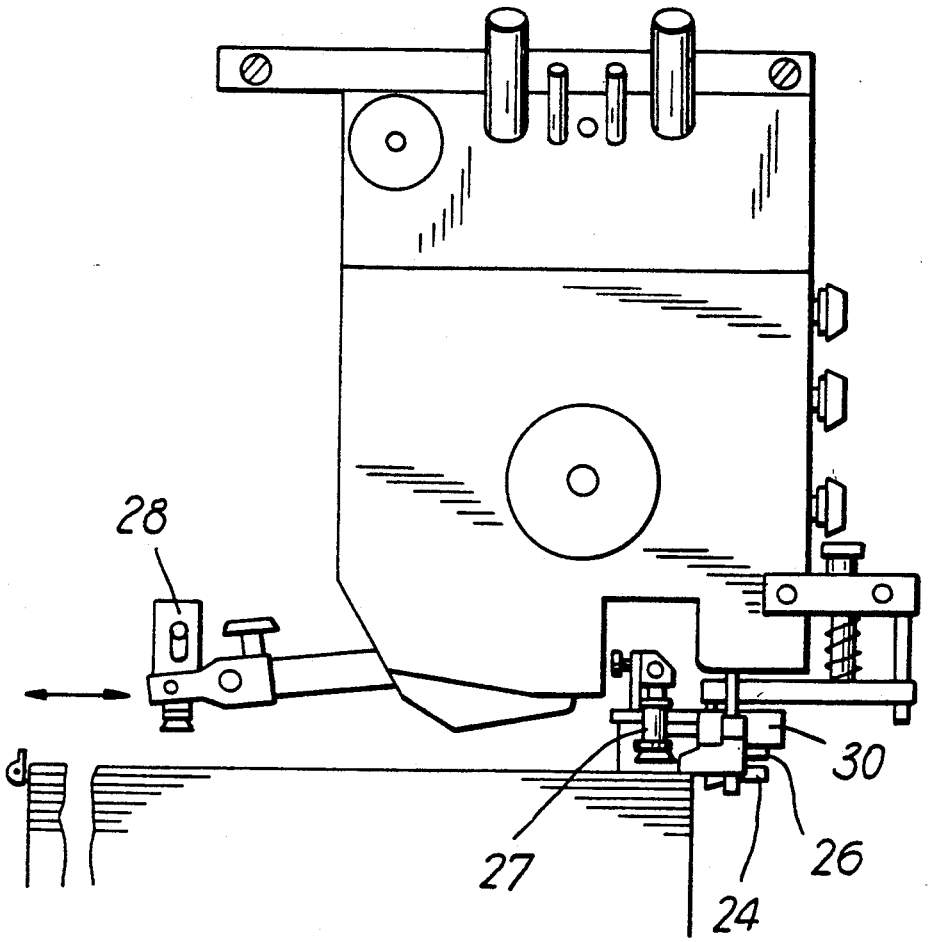
FIG. 5 is a cross sectional view through the apparatus for separating and conveying stacked sheets shown in FIG. 4 taken along the section line V—V.
Figure 6:
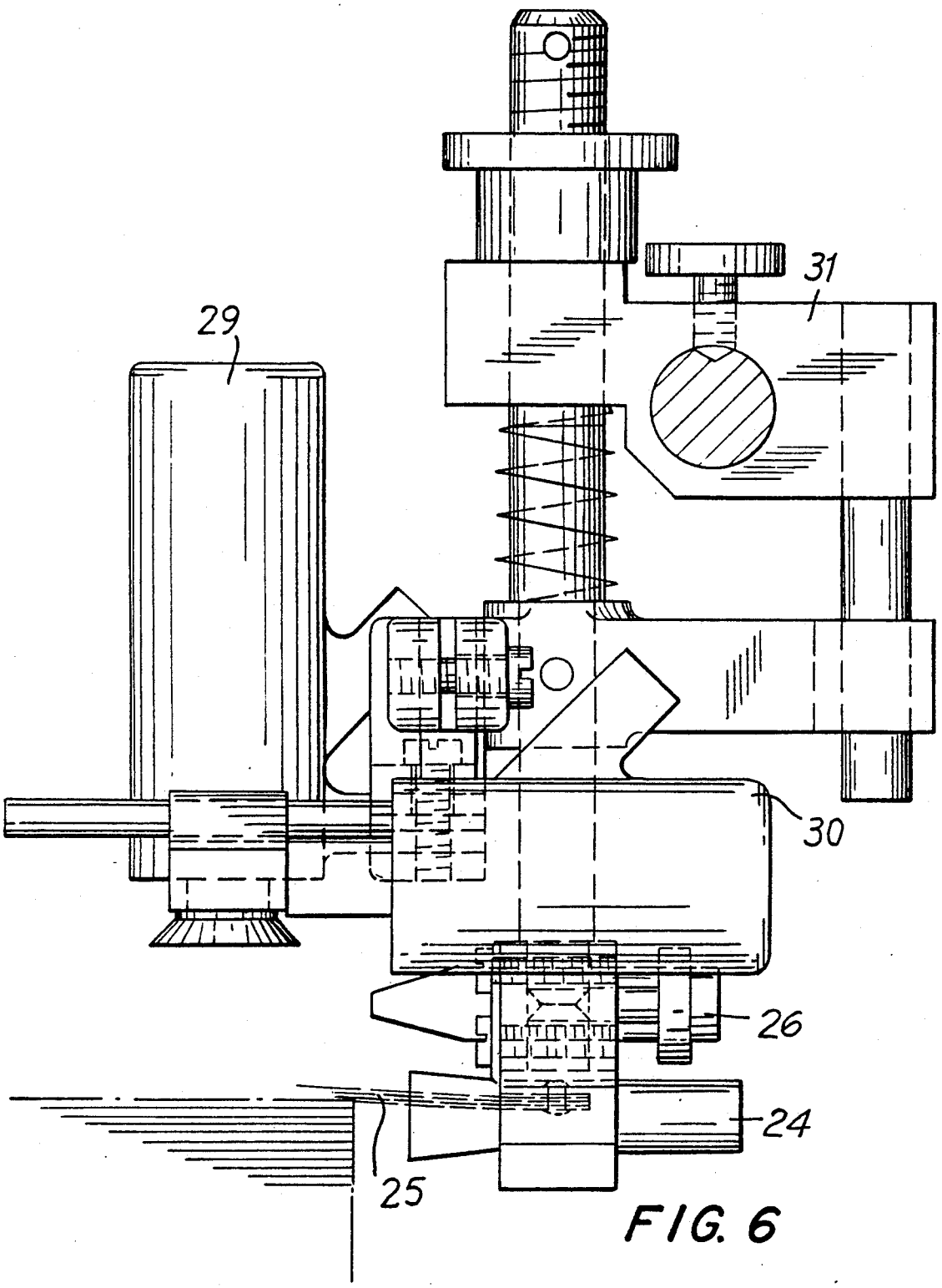
FIG. 6 is a schematic sectional view of a structural unit 31 of the apparatus for separating and conveying stacked sheets of FIG. 4 taken along the section line VI—VI of FIG. 4.
Figure 7:
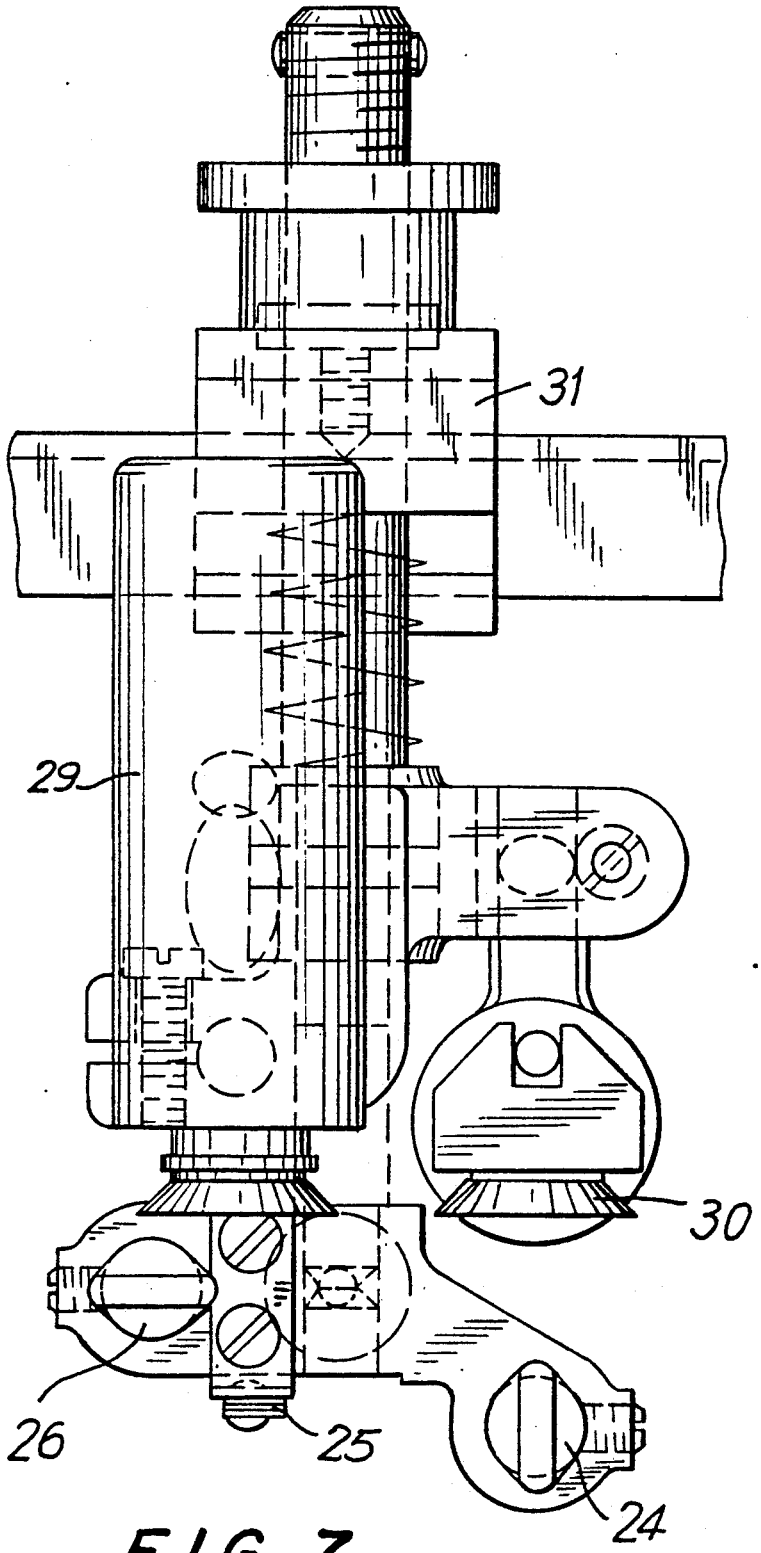
FIG. 7 is a schematic side view of a structural unit 31 of FIG. 6, which includes a second conveying suction device 30 according to my invention.

FIGS. 4 to 7 show a second conveying suction device 30 according to our invention (which is identical to that of the first embodiment) in an apparatus for separating and conveying a plurality of stacked sheets 17 shown as a whole in FIG. 4. This apparatus for separating and conveying stacked sheets comprises a plurality of preloosening blower nozzles 24.1 to 24.6, a plurality of associated skimmer elements 25.1 to 25.6, a plurality of blower nozzles 26.1 to 26.6 and a plurality of first mechanically transported separating suction devices 27.1 to 27.4 as well as a plurality of first mechanically transported conveying suction devices 28. The blower nozzles 24.1 to 24.6 are provided for blowing under individually separated sheets. A second group of separating suction devices 29.1 to 29.4 are also provided which operate according to the pressure difference principle and are the separating suction devices with which the second conveying suction devices 30 are associated. Second conveying suction devices 30.1 and 30.2 are part of a plurality of uniformly spaced structural units 31 shown in more detail in FIGS. 6 and 7. Without these second conveying suction devices 30.1 to 30.6 the structural unit 31 becomes the functional unit of the prior art referred to in the claims below.

It will be understood that each of the elements described above, or two or more together, may also find a useful application in other types of structures differing from the types described above.

While the invention has been illustrated and described as embodied in an apparatus for separating and feeding stacked sheets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims.

What is claimed is:

1. In an apparatus for separating and conveying a plurality of stacked sheets, comprising a plurality of preloosening blower nozzles (24.1 to 24.6), skimmer elements (25.1 to 25.6), blower nozzles (26.1 to 26.6) for blowing under a separated sheet from said stacked sheets, each of said skimmer elements being associated with one of said preloosening blower nozzles, said preloosening blower nozzles (24.1 to 24.6), skimmer elements (25.1 to 25.6) and blower nozzles (26.1 to 26.6) being located in the vicinity of a rear edge of said stacked sheets, a plurality of first separating suction devices (27.1 to 27.4) movable mechanically in a vertical direction and locatable in the vicinity of the rear edge of the stacked sheets, and a plurality of first conveying suction devices (28) movable mechanically in a horizontal direction locatable in the vicinity of a front portion of said stacked sheets, as well as a plurality of second separating suction devices (29.1 to 29.4) locatable in the vicinity of the rear edge of the stacked sheets and operating according to a pressure difference principle; in which a plurality of structural units are formed, each of said structural units being located in the vicinity of the rear edge of the stacked sheets and having a single one of said preloosening blower nozzles (24.1 to 24.6) positioned in the vicinity of said rear edge to act on said stacked sheets, a single one of said skimmer elements (25.1 to 25.6) mounted adjacent said single one of said preloosening blower nozzles and directed toward said stacked sheets in the vicinity of said rear edge, a single one of said blower nozzles (26.1 to 26.6) positioned adjacent said skimmer element and said preloosening blower nozzle in the vicinity of said rear edge for blowing under said separated sheet and a single one of said second separating suction devices (29.1 to 29.4) located adjacent said preloosening blower nozzle, said skimmer element and said blower nozzle in the vicinity of said rear edge, and said structural units are mounted horizontally side-by-side and spaced uniformly from each other along a feed direction of said sheets in the vicinity of said rear edge and said structural units being structured so that said separating suction devices can engage said stacked sheets, the improvement comprising a plurality of second conveying suction devices (30.1 to 30.6) positioned in the vicinity of the rear edge of said stacked sheets and wherein each of said structural units has at least one of said second conveying suction devices positioned adjacent said second separating suction device of said structural unit, each of said second conveying suction devices comprising a housing including a cylinder having a suction air connector, a guide sleeve having a length mounted in said cylinder, a piston having a piston rod axially slidably mounted in said guide sleeve in said cylinder, a spring, and a suction head mounted on a guide element, said spring being positioned so that said piston is urged into a normal position in said cylinder by said spring, said piston rod having an axially throughgoing suction duct and a wall adjacent said suction duct provided with a throughgoing passage having outer edges and located between said piston and said guide sleeve for operational connection of said suction head, and said wall also being provided with an air feed opening having outer edges positioned in the feed direction of said sheets from said passage between said passage and said suction head, so that a distance between the outer edges of said air feed opening and said passage corresponds to a distance at most equal to the length of said guide sleeve and a distance of said passage from said piston corresponds at least to the axial width of said air feed opening.

2. The improvement as defined in claim 1, wherein an end portion of said piston rod remote from said suction head projects through said housing and is slidably mounted axially in a second guide sleeve, so that a cylindrical space is formed by said housing, said piston, said guide sleeve and said end portion of said piston rod projecting through said housing, and said cylindrical space is connected operationally by a connecting opening in said wall with said suction duct.

3. The improvement as defined in claim 2, wherein said guide element is a guide bolt.

4. The improvement as defined in claim 3, wherein said suction head is mounted movably on said guide bolt adjacent an end of said piston rod most remote from said piston.

5. A conveying suction device for an apparatus for separating and conveying stacked sheets, comprising a housing including a cylinder having a suction air connector, a guide element attached to said cylinder, a guide sleeve mounted in said cylinder, a piston having a piston rod axially slidably mounted in said guide sleeve in said cylinder, a spring in said cylinder acting on said piston and a suction head mounted movably on the guide element, said suction head being attached to said piston rod, said piston being urged into a normal position in said cylinder by said spring located in said cylinder, said piston rod having an axially throughgoing suction duct and also a wall adjacent said suction duct provided with a throughgoing passage located between said piston and said guide sleeve for operation connection of said suction head and also with an air feed opening located in a sheet feed direction from said throughgoing passage between said passage and said suction head, said air feed opening and said passage each having outer edges, so that a distance between the outer edges of said air feed opening and said passage corresponds to a distance at most equal to a length of said guide sleeve and a distance of said passage from said piston corresponds at least to an axial width of said air feed opening.

* * * * *